US007538735B2

(12) United States Patent
Crouch

(10) Patent No.: US 7,538,735 B2
(45) Date of Patent: May 26, 2009

(54) ACTIVE TRANSMIT ARRAY WITH MULTIPLE PARALLEL RECEIVE/TRANSMIT PATHS PER ELEMENT

(75) Inventor: David Crouch, Corona, CA (US)

(73) Assignee: Raytheon Company, Waltham, MA (US)

( * ) Notice: Subject to any disclaimer, the term of this patent is extended or adjusted under 35 U.S.C. 154(b) by 96 days.

(21) Appl. No.: 11/590,490

(22) Filed: Oct. 30, 2006

(65) Prior Publication Data

US 2007/0046547 A1 Mar. 1, 2007

Related U.S. Application Data

(63) Continuation-in-part of application No. 10/734,445, filed on Dec. 12, 2003, now Pat. No. 7,034,751.

(51) Int. Cl.
*H01Q 19/06* (2006.01)
*H01Q 1/38* (2006.01)

(52) U.S. Cl. ..... 343/754; 343/700 MS

(58) Field of Classification Search ..... 343/700 MS, 343/754, 853; 342/372
See application file for complete search history.

(56) References Cited

U.S. PATENT DOCUMENTS 4,509,055 A * 4/1985 Fassett ..... 343/754
4,517,570 A * 5/1985 Gray, Jr. ..... 342/372
4,763,085 A * 8/1988 Lamberg ..... 331/56
4,973,972 A * 11/1990 Huang ..... 343/700 MS
5,870,063 A * 2/1999 Cherrette et al. ..... 343/853

* cited by examiner

*Primary Examiner*—Michael C Wimer
(74) *Attorney, Agent, or Firm*—John J. Horn

(57) ABSTRACT

An antenna including an array of N-port receive antennas; an array of M-port transmit antennas; and a plurality of cells for coupling the receive antennas to the transmit antennas, each cell having plural amplifiers coupled between the receive antenna and the transmit antenna thereof. The amplifiers may be replaced with injection-locked oscillators. In the best mode, an arrangement is included for distributing signals between the ports of the receive antenna and the amplifiers and between the amplifiers and the transmit antenna. This arrangement may be a manifold such as a network of power combiners and dividers.

50 Claims, 10 Drawing Sheets

ACTIVE TRANSMIT ARRAY WITH MULTIPLE PARALLEL RECEIVE/TRANSMIT PATHS PER ELEMENT

REFERENCE TO RELATED APPLICATION

This is a continuation-in-part of U.S. patent application Ser. No. 10/734,445 entitled, REFLECTIVE AND TRANSMISSIVE MODE MONOLITHIC MILLIMETER WAVE ARRAY AND IN-LINE AMPLIFIER USING SAME, filed Dec. 12, 2003, now U.S. Pat. No. 7,034,751 by K. W. Brown et al., the teachings of which are therefore incorporated herein by reference.

BACKGROUND OF THE INVENTION

1. Field of the Invention

The present invention relates to antennas. More specifically, the present invention relates to high-power, millimeter-wave antennas, systems and components that are portable in general and have solid-state sources in particular.

2. Description of the Related Art

Directed-energy systems have been considered for a variety of applications. In particular, millimeter-wave based systems are receiving ever increasing interest for both commercial and military applications. Millimeter-wave reflect arrays using solid-state power generating circuitry have been constructed and tested. See U.S. Pat. No. 6,765,535 entitled MONOLITHIC MILLIMETER WAVE REFLECT ARRAY SYSTEM, issued Jul. 20, 2004, by K. W. Brown et al. the teachings of which are hereby incorporated herein by reference.

In a reflect array, the losses are minimized by feeding the array elements via free space. Each element is equipped with a transmit and a receive antenna (which may be one and the same). The power received by the receive antenna feeds a power amplifier whose output is injected into the input of the transmit antenna and reradiated. The transmit and receive antennas are usually orthogonally polarized to provide isolation between the transmit and receive paths. These have worked well, but are limited by the need to isolate the transmit and receive paths. To increase per-element power generation requires that the outputs of multiple power amplifiers be combined on-chip, requiring the use of power combiners that consume valuable surface area that might otherwise be occupied by additional power amplifiers. In addition, the need for an external feed structure limits reflect arrays for certain applications.

A transmit array, such as that disclosed and claimed in the above-identified parent application, and quasi-optical power combiners in general address some of the shortcomings associated with reflect arrays. However, the power output of such arrays remains too limited with respect to certain applications.

The conventional approach to millimeter-wave power generation involves the use of transmitters utilizing vacuum electron devices (VEDs) such as gyrotrons or klystrons. There are numerous known shortcomings associated with the use of VEDs. For example, they tend to be heavy and bulky and require high-voltage power supplies. In addition, high-power VEDs have long warm-up and/or cool-down times, are of questionable reliability, and are fragile. Hence, high-power VED based systems are not easily portable, and are expensive and too fragile for many applications. Further, these devices are typically not scaleable.

Hence, a need remains in the art for an improved system or method for generating and directing high-power millimeter-wave energy.

SUMMARY OF THE INVENTION

The need in the art is addressed by the antenna of the present invention. In the most general embodiment, the antenna includes an array of N-port receive antennas; an array of M-port transmit antennas; and a plurality of cells for coupling the receive antennas to the transmit antennas, each cell having plural amplifiers coupled between the receive antenna and the transmit antenna thereof.

The amplifiers may be replaced with injection-locked oscillators. In a specific implementation, the antenna further includes an arrangement for maintaining the cells in a predetermined relative orientation. In the best mode, an arrangement is included for distributing signals between the ports of the receive antenna and the amplifiers and, between the amplifiers and the transmit antenna. This arrangement may be a manifold constructed from power combiners and/or dividers, e.g., using Wilkinson power combiners (which may be utilized to implement both functions). In the illustrative embodiment, the antennas are patch antennas with eight ports. Circuitry may be included for receiving a signal at a first frequency and transmitting the signal at a second frequency and/or for receiving a signal with a first polarization and transmitting the signal with a second polarization. The transmit antenna and the receive antenna of at least one of the cells may point in different directions and may be spatially separated. The transmit and receive antennas may be of different shapes or configurations and the arrays thereof may be conformal to curved surfaces. Beam steering may be effected by illuminating the receive array at a non-normal angle of incidence and/or with the use of phase shifters.

The invention addresses the need in the art by decoupling functions of reception, power generation, and transmission. In a transmit array implementation, the invention uses separate arrays of antenna elements to implement the receive and transmit functions. One array receives electromagnetic power from a seed source, usually in the form of a collimated beam spread uniformly over the receiving array. Each element captures a small portion of the incident power. In the illustrative embodiment, the receive element is a multiple-port patch antenna, so the received power is divided equally among the receive ports. The power received at each feed port is then directed to the input of a millimeter-wave power amplifier whose output feeds a corresponding input port on the transmitting antenna array. In this way, the receiving array acts as a power divider by dividing the received power equally among all power generation paths, while the transmitting array acts as a power combiner by combining the outputs of the power amplifiers belonging to a single element. Among the advantages of this approach are the following; it is scalable, it makes possible greater power generation per element while reducing or eliminating the need for power combiners and power dividers, it offers significant redundancy in that an element will fail gracefully if individual receive/transmit paths fail, and the separation of functions allows greater latitude in system design and layout.

DESCRIPTION OF THE INVENTION

Illustrative embodiments and exemplary applications will now be described with reference to the accompanying drawings to disclose the advantageous teachings of the present invention.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

In the illustrative embodiment, the invention is implemented as an active transmit array with multiple parallel receive/transmit paths per element.

Figure 1:
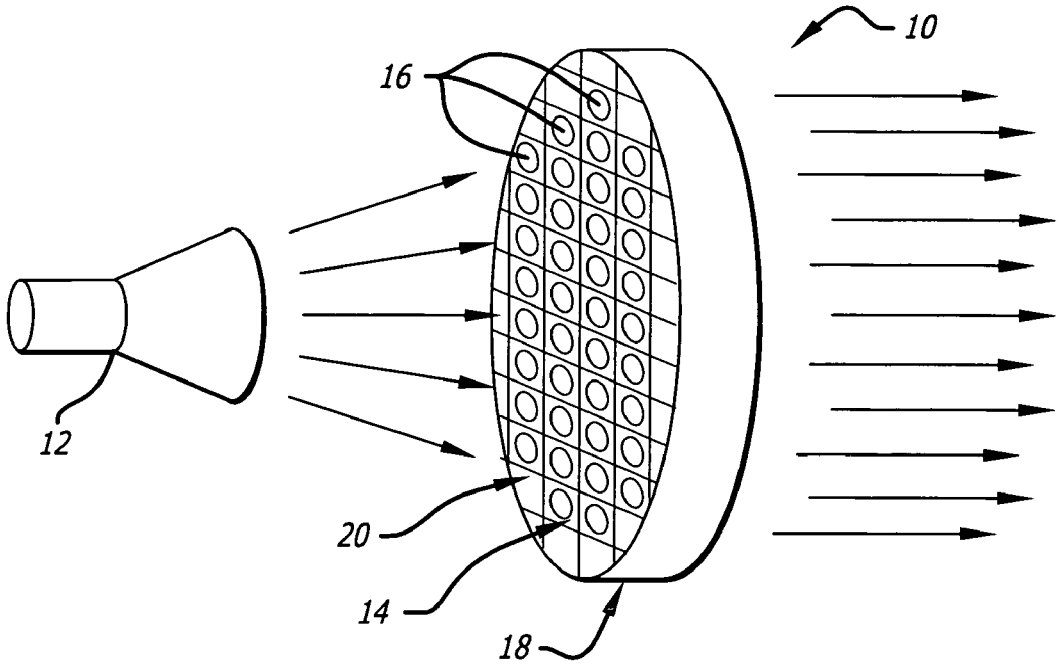
FIG. 1 is a perspective view of an antenna implemented in accordance with an illustrative embodiment of the present teachings.

FIG. 1 is a perspective view of an antenna implemented in accordance with an illustrative embodiment of the present teachings. As shown in FIG. 1, in a most general embodiment, the antenna 10 includes a first array 14 of N-port receive antennas 16 mounted on a first substrate retained by a housing 18 to receive electromagnetic energy from a feed source 12. In the best mode, the antenna 10 uses multiple-port patch antennas for reception and transmission. See MULTIPLE-PORT PATCH ANTENNA, Ser. No. 10/883,093 filed Jul. 1, 2004 by D. Crouch et al. and WIDE BAND POWER-COMBINING, MULTI-PORT PATCH ANTENNA, Ser. No. 11/940,499 filed Nov. 15, 2007 by D. Crouch et al. the teachings of which are incorporated herein by reference.

In the illustrative embodiment, the feed source 12 supplies energy in the millimeter-wave range although the present teachings are not limited thereto. Each element 16 in the first array 14 receives energy from the feed source 12 and divides it equally among N receive ports. The phase relationships among different ports depend upon the design of the antenna, the number of ports used, and on the polarization of the incident radiation.

An array 30 of M-port transmit antennas 32 (not shown) is mounted on a second plane parallel to and facing in the opposite direction with respect to the first plane on a substrate retained by the housing 18.

In the best mode, the arrays are implemented in m-HEMT, InP on GaA (indium-phosphide on gallium-arsenide), GaN (gallium-nitride) or other suitable material in accordance with the teachings of U.S. Pat. No. 6,765,535 entitled MONOLITHIC MILLIMETER WAVE REFLECT ARRAY SYSTEM, issued Jul. 20, 2004, by K. W. Brown et al. the teachings of which are hereby incorporated herein by reference. See also U.S. patent application entitled SERIES FED AMPLIFIED REFLECT ARRAY, filed Aug. 22, 2006, by K. Brown, U.S. patent application entitled REFLECT ANTENNA (PLANAR REFLECT ARRAY WITH SEPARATE TRANSMIT AND RECEIVE ANTENNAS AND POLARIZATION TWIST FOR APPLICATION THROUGH W-BAND), filed Sep. 9, 2004, by Herrick, U.S. patent application entitled SYSTEM AND LOW-LOSS MILLIMETER-WAVE CAVITY-BACKED ANTENNAS WITH DIELECTRIC AND AIR CAVITIES, filed Mar. 10, 2004, by K. Brown, U.S. patent application entitled WIDE BAND POWER-COMBINING, MULTI-PORT PATCH ANTENNA, filed Nov. 15, 2007, by Crouch et al., U.S. patent application entitled AMPLIFIED PATCH ANTENNA ARRAY, filed Aug. 22, 2006, by K. Brown, U.S. patent application entitled BIAS LINE DECOUPLING METHOD FOR MONOLITHIC AMPLIFIER ARRAYS, filed Sep. 17, 2003, by Lynch, and U.S. patent application entitled ACTIVE ANTENNA ARRAY USING MONOLITHIC SUB-ARRAYS, filed Oct. 20, 2005, by K. Brown et al. the teachings of all of which are also incorporated herein by reference.

A plurality of cells 20 are disposed within the housing for coupling the receive antennas 16 to the transmit antennas 32. In the illustrative embodiment of FIG. 1, the housing 18 serves to maintain the cells and the antennas in a predetermined relative spatial orientation. However, as discussed more fully below, the invention is not limited thereto.

Figure 2:
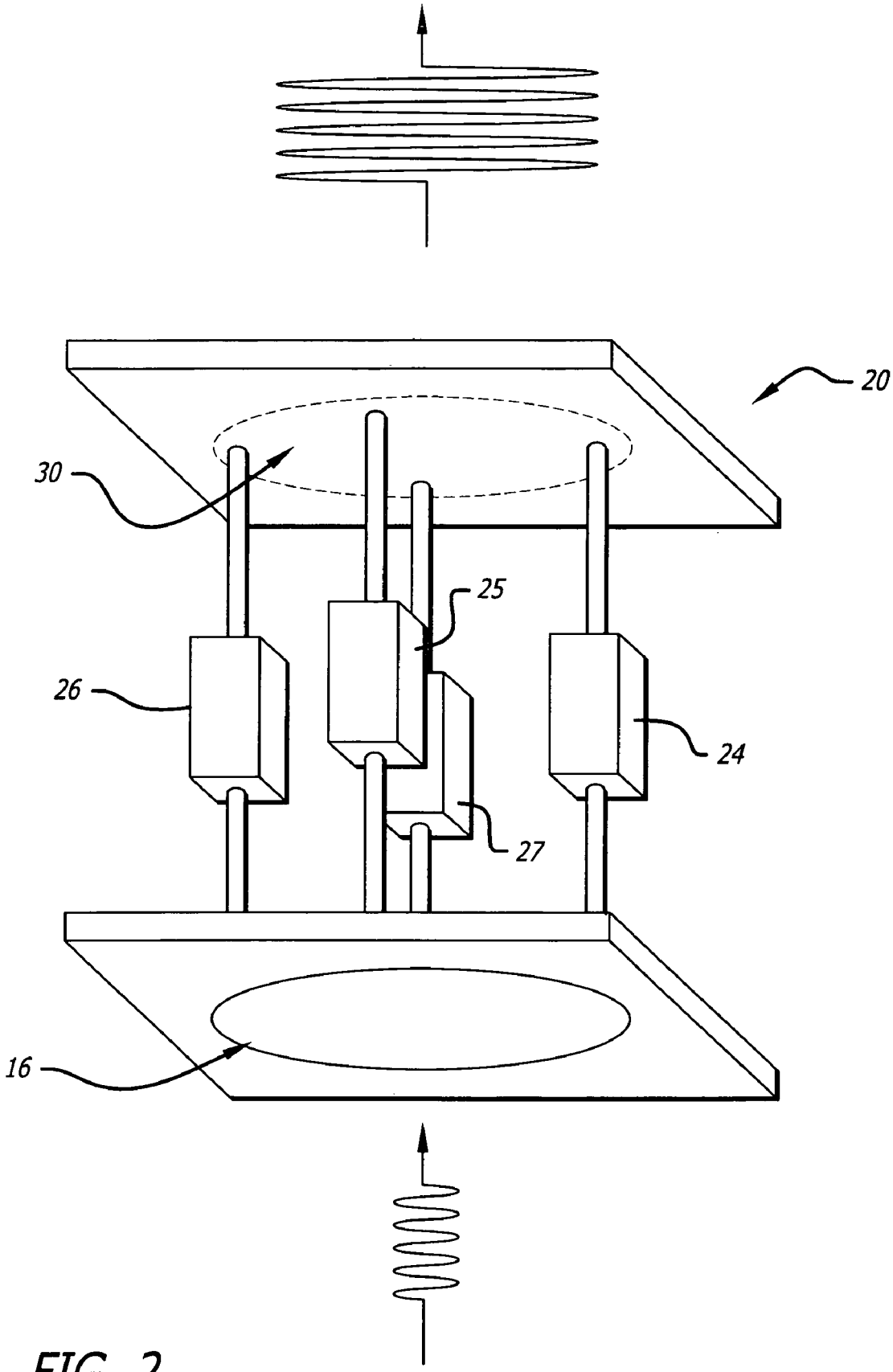
FIG. 2 is a perspective view of an illustrative implementation of a single cell of the antenna array of FIG. 1.

FIG. 2 is a perspective view of an illustrative implementation of a single cell of the antenna array of FIG. 1. As shown in FIG. 2, in a first embodiment, each cell 20 has plural amplifiers 24-27 coupled between the receive antenna 16 and the transmit antenna 32 thereof. However, those skilled in the art will appreciate that other circuitry may be provided in the cells depending on the requirements of the application. For example, as discussed more fully below, the amplifiers may be replaced by or used with injection-locked oscillators and/or phase shifters.

Figure 3:
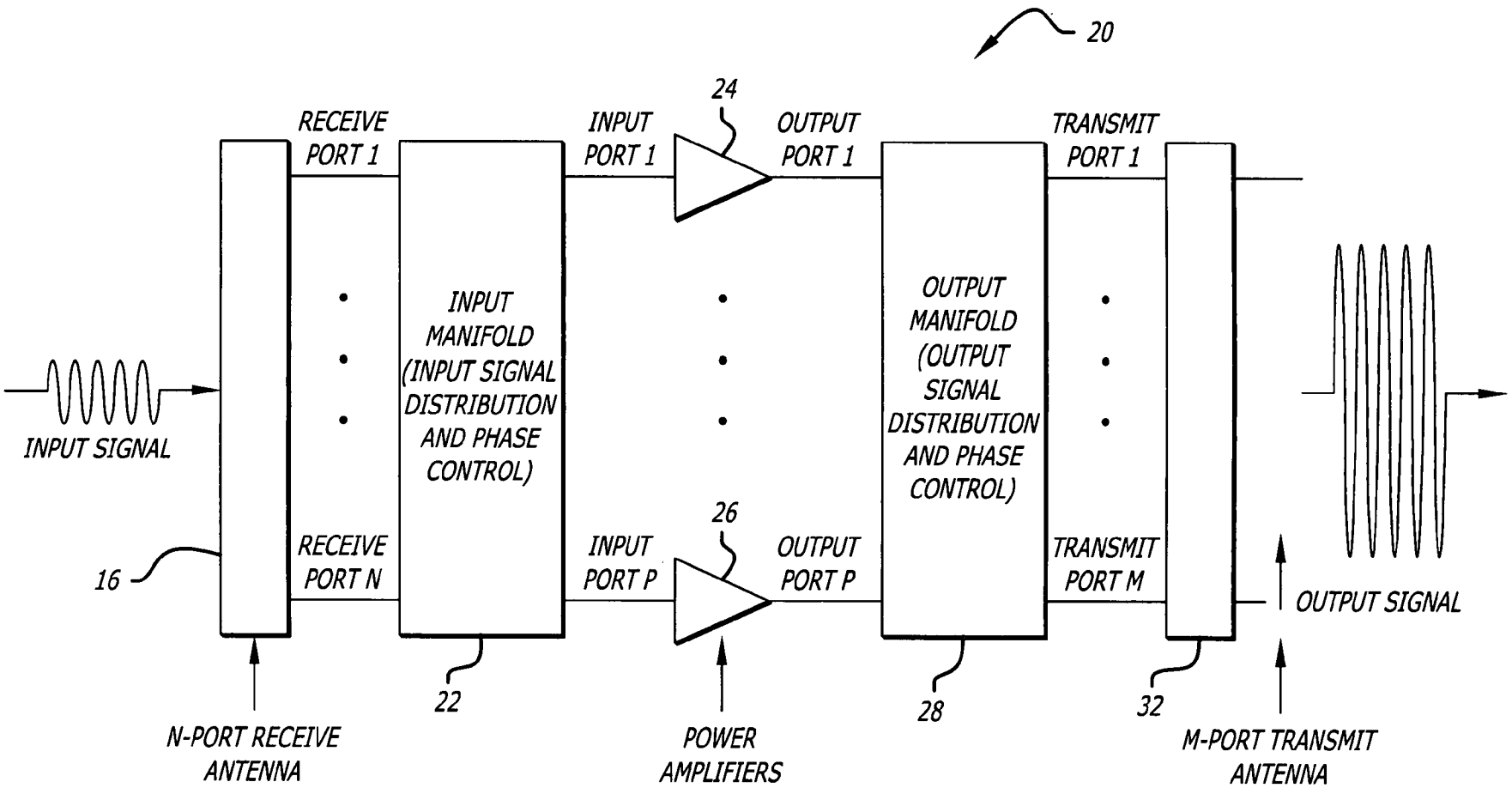
FIG. 3 is a block diagram of a single cell of the antenna of FIG. 1 with multiple parallel receive/transmit paths in accordance with the present teachings.

FIG. 3 is a block diagram of an illustrative embodiment of a single cell of the antenna of FIG. 1 with multiple parallel receive/transmit paths in accordance with the present teachings. In the best mode, each element or cell 20 includes an arrangement for distributing signals between the ports of a receive antenna element 16 and P amplifiers 24-26 and between the amplifiers and a transmit antenna element 32. (In the present disclosure, 'M', 'N' and 'P' are integers.) This arrangement may be a manifold 22 such as a power combiner or divider network utilizing Wilkinson power combiners, for example.

Figure 4:
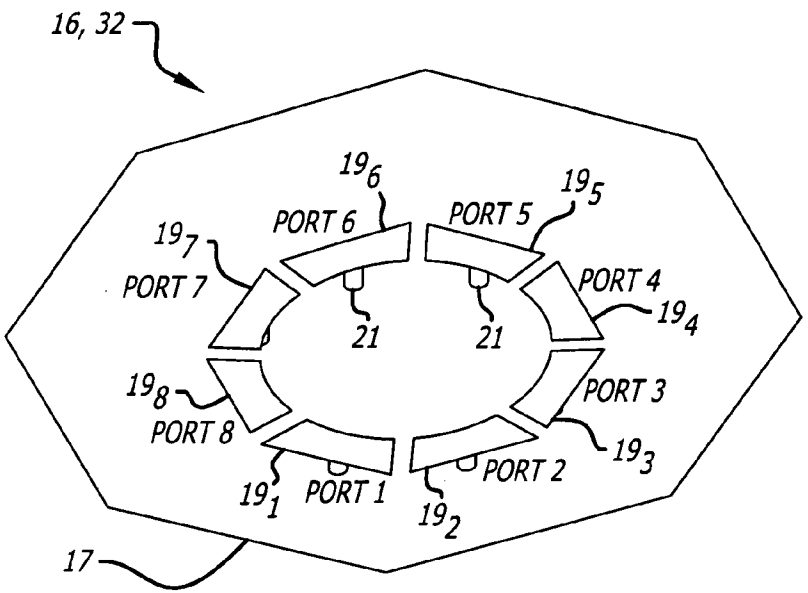
FIG. 4 shows an illustrative embodiment of a multiport antenna element for reception and transmission in accordance with an illustrative embodiment of the present teachings.

FIG. 4 shows an illustrative embodiment of a multiport antenna element for reception and transmission in accordance with an illustrative embodiment of the present teachings.

Figure 5:
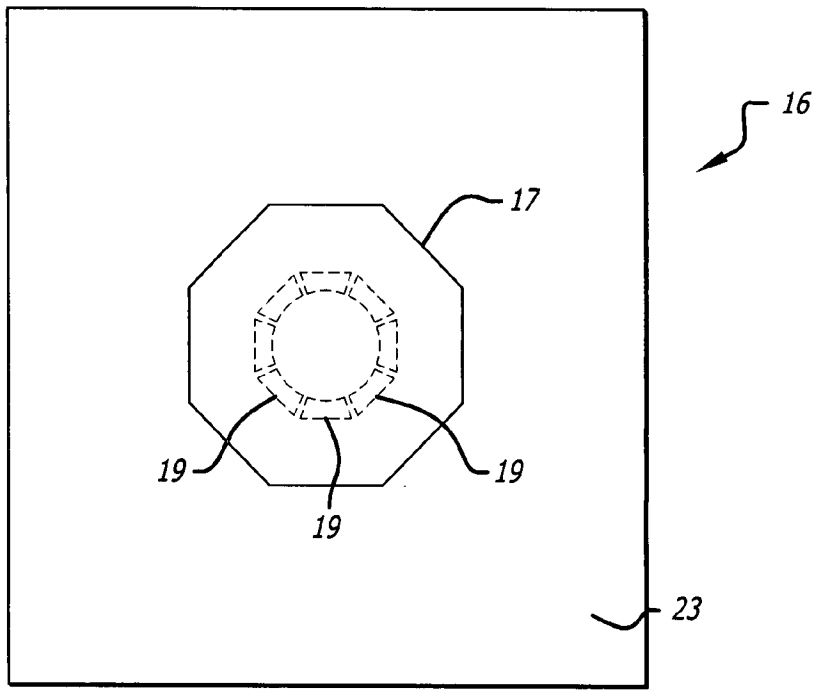
FIG. 5 is a top view of the multiport antenna element of FIG. 4.

FIG. 5 is a top view of the multiport antenna element of FIG. 4.

Figure 6:
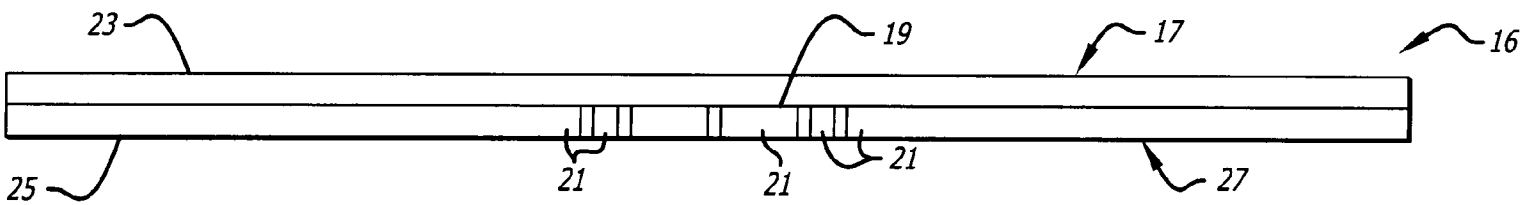
FIG. 6 is a side view of the multiport antenna element of FIG. 4.

FIG. 6 is a side view of the multiport antenna element of FIG. 4.

As shown in FIGS. 4-6, in the illustrative embodiment, each antenna element is implemented as an eight-port patch array element. However, those skilled in the art will appreciate that each antenna element may be implemented with other multiple-port antenna technologies without departing from the scope of the present teachings. In addition, the elements of the array need not be uniform in size, shape, spacing and technology. That is, the antenna array elements may be implemented with dissimilar antenna geometries and/or technologies. Further, the invention is not limited to the number of ports shown in the illustrative embodiment. Those of ordinary skill in the art will appreciate that the feed structure of the transmit and receive elements can be optimized for a particular application without departing from the scope of the present teachings.

As shown in FIGS. 4-6, each antenna element 16, 32 includes a patch radiator 17 implemented with an area of conductive material in a conventional manner. Energy received by the radiator 17 is coupled to each of the ports (1-8) via associated feed lines $\mathbf{19}_{1\text{-}8}$. Each feed line 19 is constructed with a conductive material such as copper. Each feed line $\mathbf{19}_{1\text{-}8}$ is fed by an associated probe $\mathbf{21}_{1\text{-}8}$.

As shown more clearly in the side view of FIG. 6, each radiator 17 is mounted on a first (upper substrate) 23. The upper substrate 23 may be any suitable low-loss dielectric material such as Duroid™ or other suitable material as is known in the art. A second (lower) substrate 25 is mounted under the first substrate 23. In the illustrative embodiment, the feed lines 19 are mounted between the upper and lower substrates 23 and 25 respectively. The probes $\mathbf{21}_{1\text{-}8}$ extend through the lower substrate between the feed lines $\mathbf{19}_{1\text{-}8}$ and a ground plane 27. The probes carry the input signals through holes in the ground plane. The feed lines collectively form a feed structure for the radiator inasmuch as it is electromagnetically coupled to the patch radiator. The radiator radiates most of the coupled radiation into space or in the case of a receive implementation, receives radiation from space and couples it into the probes. Those skilled in the art will appreciate that different feed mechanisms can be implemented without departing from the scope of the present teachings. For example, each probe may be directly connected to the patch radiator or the coupling from the feed lines to the patch radiator may be mediated by slots cut into a ground plane separating the feed lines from the patch radiator.

The input manifold 22 performs any required combining or dividing of the N inputs from the receive antenna. It also impresses any required phase shifts on the inputs, either actively or passively. A similar arrangement is provided as an output manifold 28 for distributing power from the P amplifiers to M ports of the transmit antenna 30. The input and output manifolds may be of similar design and construction as illustrated in FIGS. 7 and 8 below.

Figure 7:
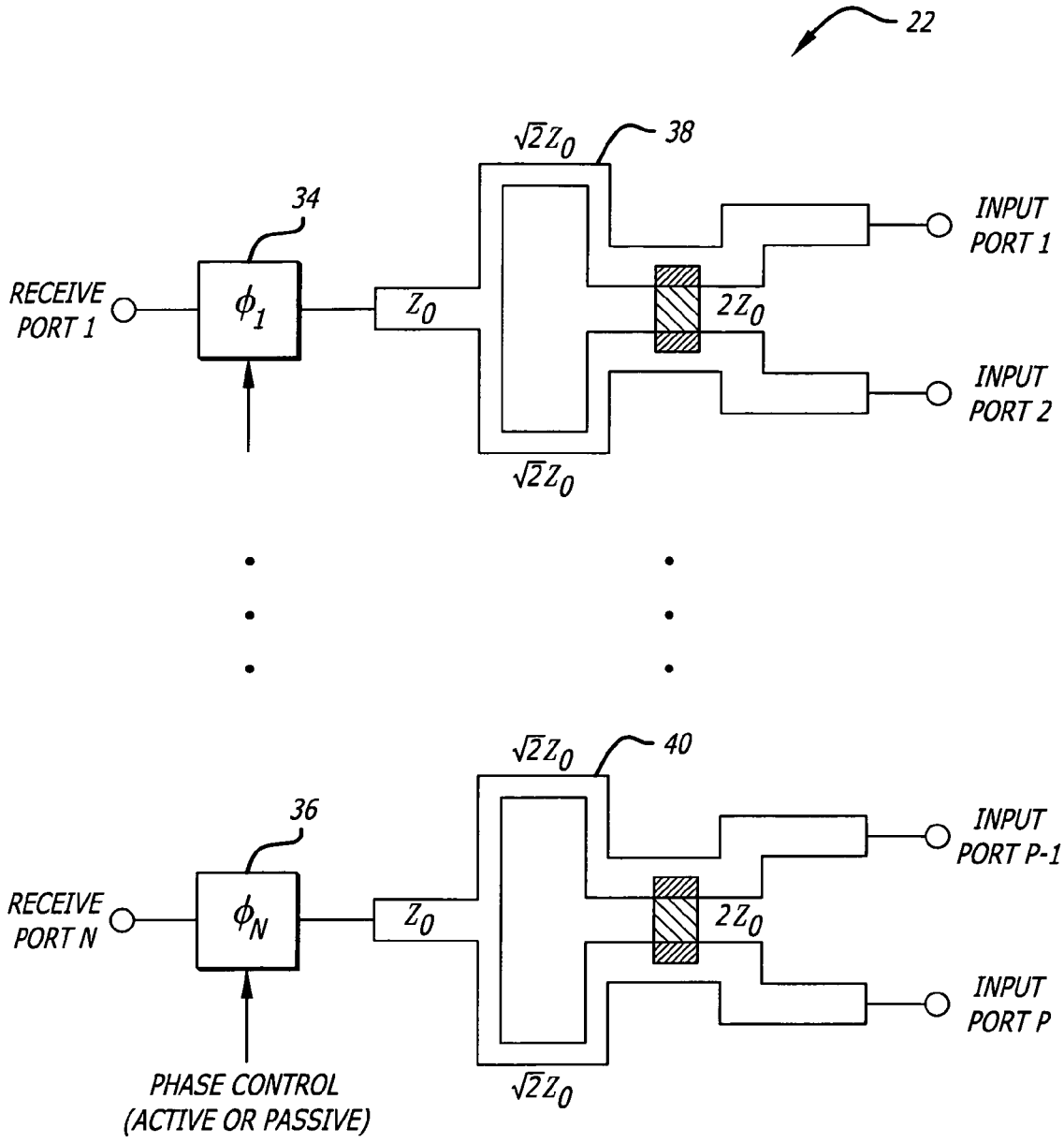
FIG. 7 is a block diagram of an illustrative implementation of the input manifold of FIG. 3.

FIG. 7 is a block diagram of an illustrative implementation of the input manifold 22 of FIG. 3. In the embodiment of FIG. 7, the number of amplifier input ports P is equal to twice the number of receive ports N. Each port of the receive antenna 16 is connected to the input of a phase-control device (e.g., a passive delay line or an active phase shifter). In practice, N phase control devices are employed of which only two (34 and 36) are shown in FIG. 7 for illustrative purposes. The output of each phase-control device is connected to a two-way Wilkinson power divider, which for the implementation shown in FIG. 7 divides the power incident on its input port equally between its two output ports. N power dividers are used in the illustrative embodiment of which only two (38 and 40) are shown in FIG. 7 for illustrative purposes.

The power amplifiers shown in FIG. 3 produce P outputs. The outputs of the power amplifiers are input to the output manifold 28. The output manifold 28 effects power combining and/or dividing of the amplified signals among the elements 30 of the transmit array. Hence, the output manifold 28 is similar in function to the input manifold 22 in that it receives the P power amplifier outputs as inputs and produces M output signals. The output manifold 28 will in general not be called upon to actively shift the phase of the output signal if the required phase shifts are performed at the input where the power levels are lowest.

Figure 8:
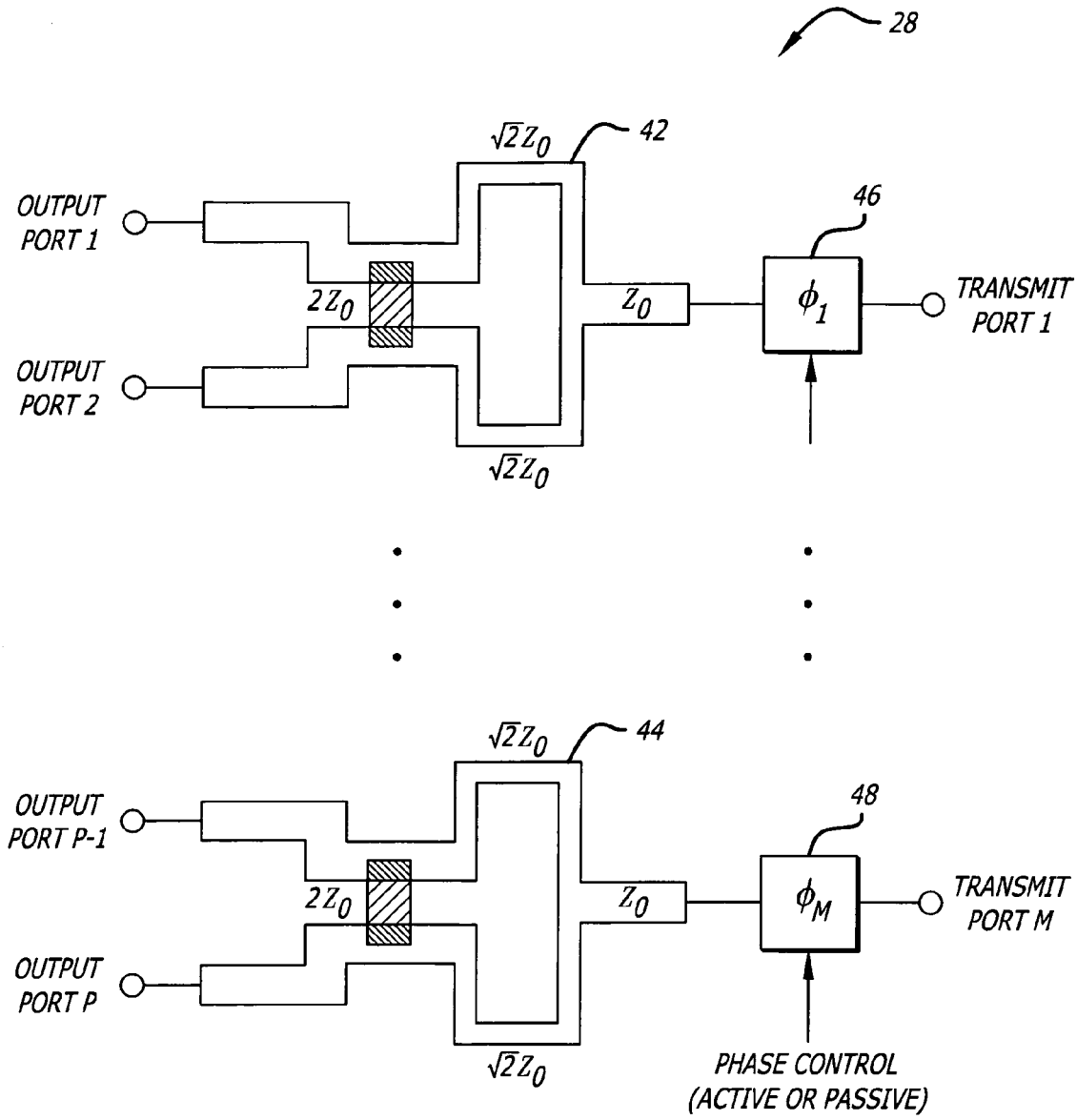
FIG. 8 is a block diagram of an illustrative implementation of the output manifold of FIG. 3.

FIG. 8 is a block diagram of an illustrative implementation of the output manifold of FIG. 3. Here, the P output ports from the power amplifiers are coupled to power dividers serving as power combiners. As per the input manifold of FIG. 7, in the best mode, power combination in the output manifold is effected with Wilkinson power dividers. M power dividers are used although only two (42 and 44) are shown for the purposes of illustration. The output of each power divider is input to a phase-control device. M phase-control devices are used in the best mode of which only two (46 and 48) are shown for the purpose of illustration.

Those skilled in the art will appreciate that other power division and power combining ratios are possible without departing from the scope of the present teachings. For example, if $P=K\times N$ (where K is an integer), the power received at each receive port can be divided K ways by a 1:K power divider, with each output of the K-way power divider feeding one of P power amplifier input ports. Or, if $P=N/K$, the power received by each of P groups of K receive ports can be combined by a K:1 power combiner, with each of the P outputs feeding one of P power amplifier input ports. These same arguments may be applied to the output manifold. Those skilled in the art will further appreciate that power divider/combiner types other than that of Wilkinson may be utilized to construct power distribution networks without departing from the scope of the present teachings.

The level of complexity of the input manifold can vary between two extremes. At one extreme, it can be very simple, consisting of N transmission lines transporting the signals received at N receive antenna output ports to N power amplifier input ports. At the other extreme, the input manifold can be complex if the number of signal inputs is different than the number of power amplifiers and if phase shifting is required. For example, if the beam radiated by the active transmit array is to be electronically scanned, phase shifters might be employed as shown in FIG. 9.

Figure 9:
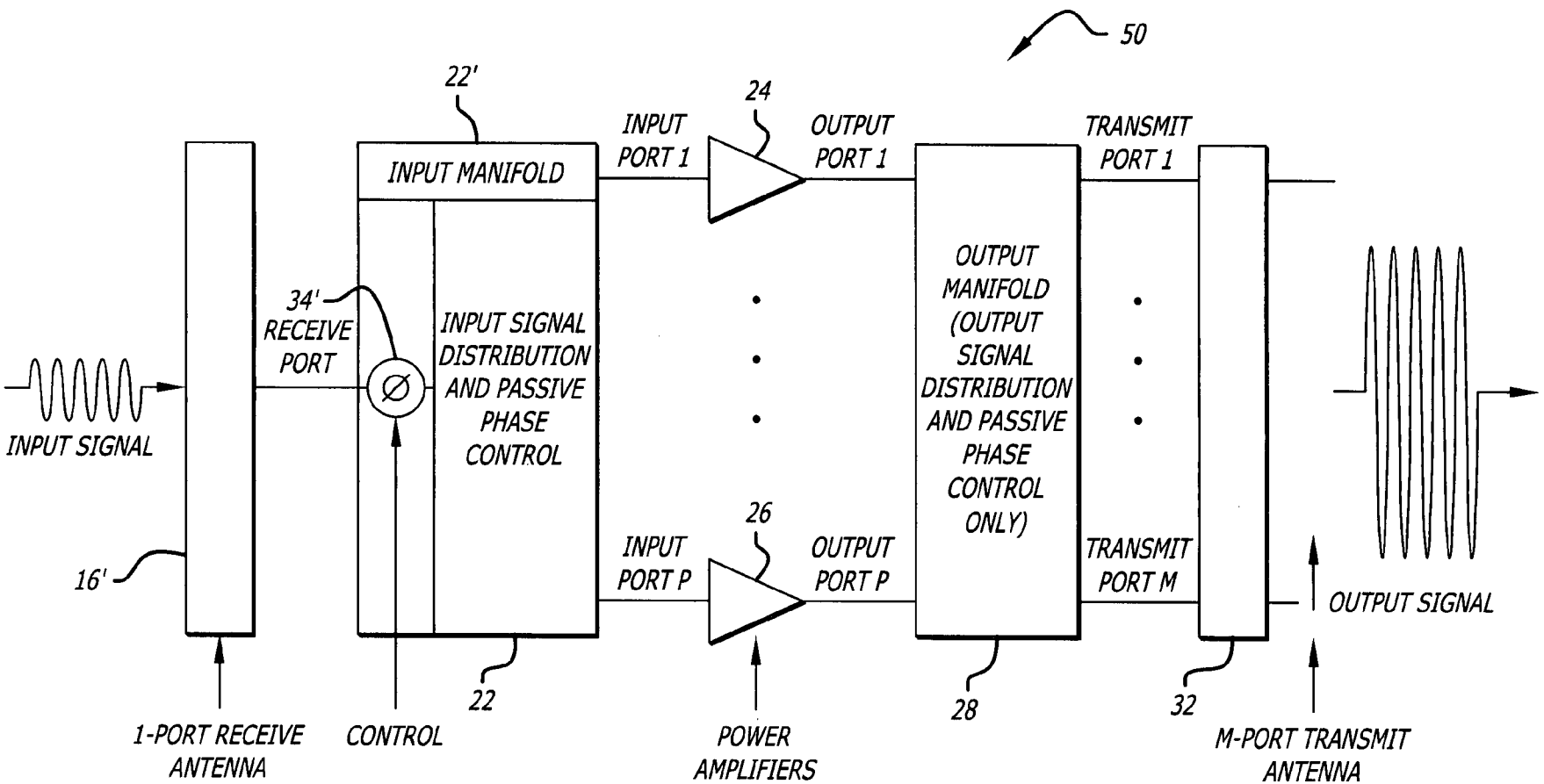
FIG. 9 is a block diagram of an alternative embodiment of a single cell of the antenna of FIG. 1 with a single receive path containing an in-line phase shifter and multiple parallel transmit paths in accordance with the present teachings.

FIG. 9 is a block diagram of an illustrative embodiment 50 of a single cell of the antenna of FIG. 1 with a single receive path and multiple parallel transmit paths in accordance with the present teachings. The illustrative embodiment shown in FIG. 9 utilizes a single-port receive antenna 16' in order to minimize the number of phase shifters needed by each transmit array element. The received signal has its phase shifted by an active phase shifter before entering the input manifold, which here is responsible for signal distribution and passive phase control only. Those skilled in the art will appreciate that receive antennas having more than one port and transmit array elements having more than one phase shifter per cell can be utilized without departing from the scope of the present teachings.

In the embodiment of FIG. 3, the number of power amplifiers 'P' may be greater than, less than or equal to the number of ports associated with the receive and/or transmit antennas. As per the input manifold, the power amplifiers can also vary in complexity. Each power amplifier can be as simple as a single-stage, single transistor amplifier or as complex as a packaged and connectorized power amplifier containing many transistors in multiple stages. Regardless of the level of complexity of the power amplifier, its function is the same, i.e., to amplify the power level of an input signal.

The output manifolds' M outputs are inputs to the transmit antenna element 32 of FIG. 3. The transmit antenna element 32 is a multiple-port antenna having M input ports. In the simplest case, the transmit antenna element 32 is identical to the receive antenna 16, having the same construction and the same number of ports. Depending on the frequency and the power level, however, the transmit antenna may be very different from the receive antenna. For example, if the power level is sufficiently high, the transmit antenna may need to withstand much higher peak electric fields and surface currents than the receive antenna, requiring use of a different design and different construction techniques.

Active array elements typically utilize only a single power amplifier per antenna element. The power amplifier must generate sufficient gain to meet the radiated power requirement while remaining stable under all operating conditions. This complicates the design of the power amplifier and drives up the cost of the array. In accordance with the present teachings, a different approach is employed by using multiple independent power amplifiers to drive each array element. An individual power amplifier can take different forms. The amplifier arrangement can be one of a large number of separately packaged identical modules, each containing a separate set of RF and DC interfaces. A realization of this type is illustrated in FIG. 2.

The amplifier arrangement can also be cast in the form of a millimeter-wave integrated circuit (MMIC) and made an integral part of a microstrip or stripline circuit. Either option allows the designer to significantly reduce the power output from each power amplifier, simplifying its design and lowering its cost. Also, because the number of separate power amplifiers needed to power the array will increase significantly, additional cost savings may be realized from economies of scale.

To more clearly illustrate the principles involved, consider an example of an antenna designed for use at 95 GHz. To this end, the eight-element circularly polarized multiple-port patch antenna shown in FIGS. 4-6 is used as both the receive and the transmit antenna. In this illustrative implementation, the radiating element and its feed structure are each printed on 2 mil sheets of RT/duroid 5880 (available from Rogers Corporation, Chandler, Ariz.). As discussed above and shown in FIG. 4, the radiating element is an octagon inscribed inside a circle with a radius of 22.99 mils. The feed structure is derived from an octagon inscribed inside a circle. For the feed structure, the radius of the inscribed circle is 11.585 mils. The octagon upon which the feed structure is based is divided into eight equivalent feed lines by 1 mil gaps, and an 8.242 mil circular cutout at the center is used for tuning. As mentioned above, the eight feed lines are each fed by a probe that protrudes through the ground plane. For example, each probe could be the center conductor of a coaxial transmission line. The phase of the input signal advances by 45 degrees from one input to the next as one advances around the antenna in a counter-clockwise manner as viewed from the back of the antenna.

Each feed line is coupled to the other lines feeding a given antenna and to a lesser degree to the lines feeding neighboring antennas. Intrafeed coupling (coupling among lines feeding a given antenna) is accounted for in the design process by defining an effective reflection coefficient at each port. An isolated N-port antenna having N-fold rotational symmetry will have N equivalent ports; that is, the physical structure of the antenna and the amplitude and phase relationships among the input signals are unchanged if the antenna is rotated about its axis by 360/N degrees. In this case, symmetry guarantees that if one of the N ports is matched, all ports will be matched. The input impedance of the antenna is matched to the input transmission line when the reflection coefficient is zero. When intrafeed coupling is accounted for, the complex amplitude $B_1$ of the signal reflected from input port 1 of the eight-port antenna illustrated in FIG. 4 is $$B_1=S_{11}A_1+S_{12}A_2+S_{13}A_3+S_{14}A_4+S_{15}A_5+S_{16}A_6+S_{17}A_7+S_{18}A_8. \quad [1]$$

Here $A_1, \ldots, A_8$ are the complex amplitudes of the signals incident on the eight input ports. Assume that the magnitudes of the input signals are the same and denoted by A. If the antenna is to radiate circular polarization, the phase must change by 45 degrees from one feed to the next. To this end, let $A_1=A\exp(j0)=A$, $A_2=A\exp(j\pi/4)$, $A_3=A\exp(j\pi/2)=jA$, $A_4=A\exp(j3\pi/4)$, $A_5=A\exp(j\pi)=-A$, $A_6=A\exp(j5\pi/4)$, $A_7=A\exp(j3\pi/2)=-jA$, and $A_8=A\exp(j7\pi/4)$. The reflected signal amplitude then assumes the form:

$$B_1=S_{11}A+S_{12}A\exp(j\pi/4)+jS_{13}A+S_{14}A\exp(j3\pi/4)-S_{15}A+S_{16}A\exp(j5\pi/4)-jS_{17}A+S_{18}A\exp(j7\pi/4)$$

$$=[(S_{11}-S_{15})+(S_{12}-S_{16})\exp(j\pi/4)+j(S_{13}-S_{17})+(S_{14}-S_{18})\exp(-j\pi/4)]A \quad [2]$$

The effective reflection coefficient then is $$S_{11}^{eff}=B_1/A_1=(S_{11}-S_{15})+(S_{12}-S_{16})\exp(j\pi/4)+j(S_{13}-S_{17})+(S_{14}-S_{18})\exp(-j\pi/4). \quad [3]$$

It is this last quantity (eqn. [3]) whose magnitude is minimized during the design process.

The inter-element coupling present in an array environment must be accounted for during the design process. This phenomenon will manifest itself as interfeed coupling (coupling among lines feeding different antennas). The performance of the antenna can be optimized, while taking account of both intrafeed and interfeed coupling, using commercially available antenna design software packages (such as Designer from Ansoft Corporation). Interfeed coupling is typically handled transparently by enforcing appropriate boundary conditions on Maxwell's equations at the boundaries encompassing a single unit cell of the array.

In the present context, this means that a multiple-port antenna can be optimized for use as either a stand-alone antenna or as an array element using the same effective reflection coefficient described above. In either case, the coupling must be correctly accounted for.

The performance of the antenna may be optimized by varying the radii of the circles in which the patch and feed structures are inscribed and the radius of the hole at the center of the feed structure. When each element of the array is in phase, the radiated beam will be in the broadside direction.

If necessary, the bandwidth over which the effective reflection coefficient is less than a desired level can be increased by optimizing the antenna geometry for increased bandwidth and/or by utilizing a thicker substrate. A small effective reflection coefficient should be maintained at each port of both receive and transmit antennas. This is especially important at the input ports of the transmit antenna; a high reflection coefficient at any port reduces the amount of radiated power and may cause the amplifier feeding the associated port to oscillate.

As mentioned above, the effective reflection at each port contains a contribution due to a direct reflection from the port in question, as well as contributions due to coupling from all other ports. If the amplifier feeding one of those ports fails, one expects a falloff in performance, i.e., the effective reflection coefficient will increase. The dependence of the effective reflection coefficient on the coupling due to any one port is reduced if the transmit antenna has many ports (M>>1). One then expects the performance to degrade gracefully in this instance, i.e., the effective reflection coefficient will increase gradually as one or more amplifiers fail.

The active transmit array antenna with multiple parallel receive/transmit paths of the present invention can be generalized in a number of ways. For example, the amplifiers can be replaced by injection-locked oscillators (i.e., the oscillation frequency and phase are locked to those of the injected signal). This is illustrated in FIG. 10.

Figure 10:
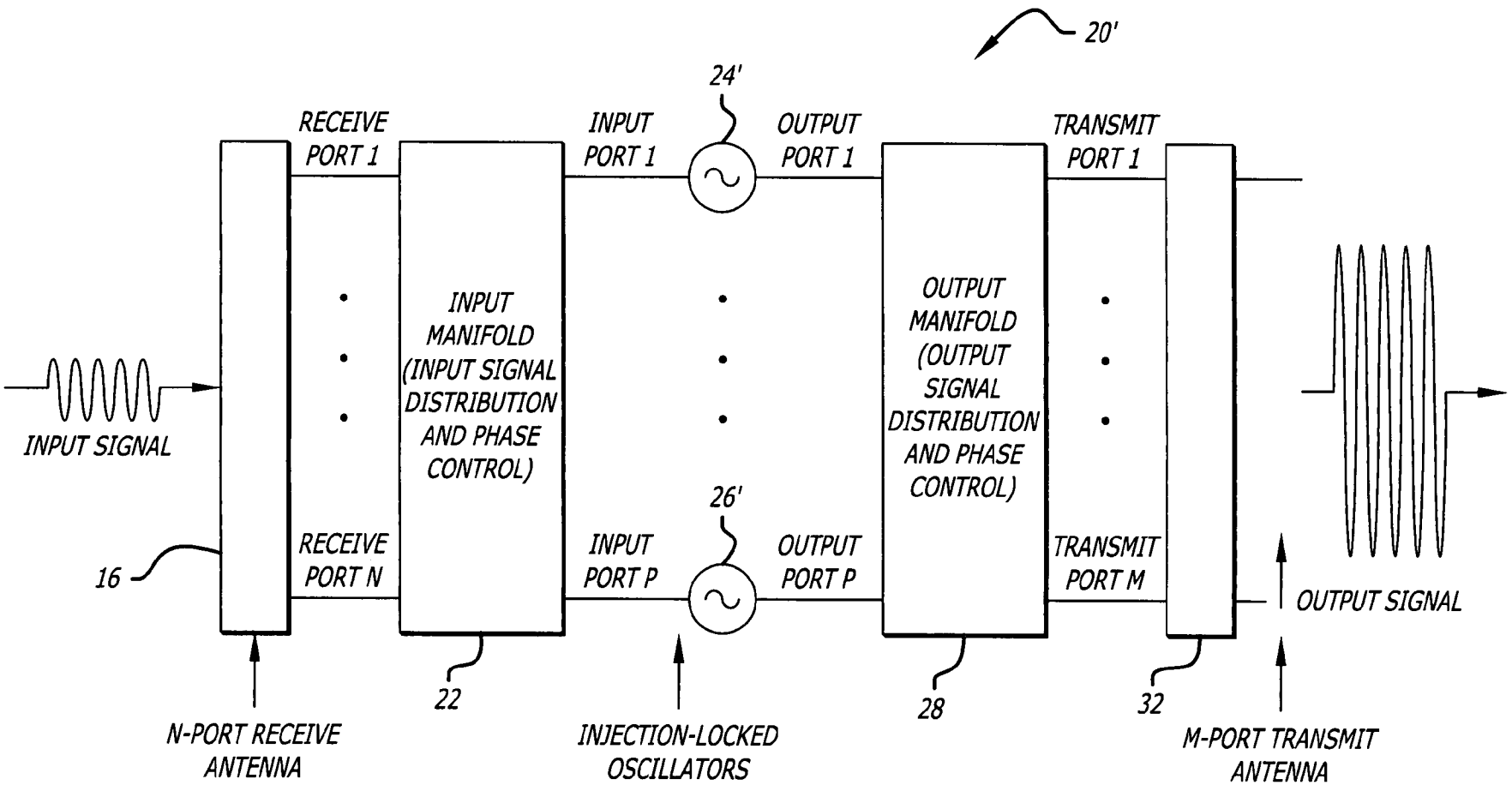
FIG. 10 is a block diagram of an alternative embodiment of a single cell of the antenna of FIG. 1 with multiple parallel receive/transmit paths implemented with injection-locked oscillators in accordance with the present teachings.

FIG. 10 is a block diagram of an alternative embodiment of a single cell of the antenna of FIG. 1 with multiple parallel receive/transmit paths implemented with injection-locked oscillators in accordance with the present teachings. In this case, one or more cells 20' is implemented as is the cell 20 of FIG. 3 with the exception that the amplifiers 24-26 are replaced by injection-locked oscillators 24'-26'. Note that a mix of oscillators, amplifiers and other circuit components may be implemented as discrete or distributed components without departing from the scope of the present teachings.

The received and transmitted signals can be of different frequencies without departing from the scope of the present teachings. In this case, each transmit array element would be equipped with a frequency upconverter, mixer, or multiplier to convert the frequency of the received signal to the transmitted signal frequency prior to amplification. This is illustrated in FIG. 11 below.

Figure 11:
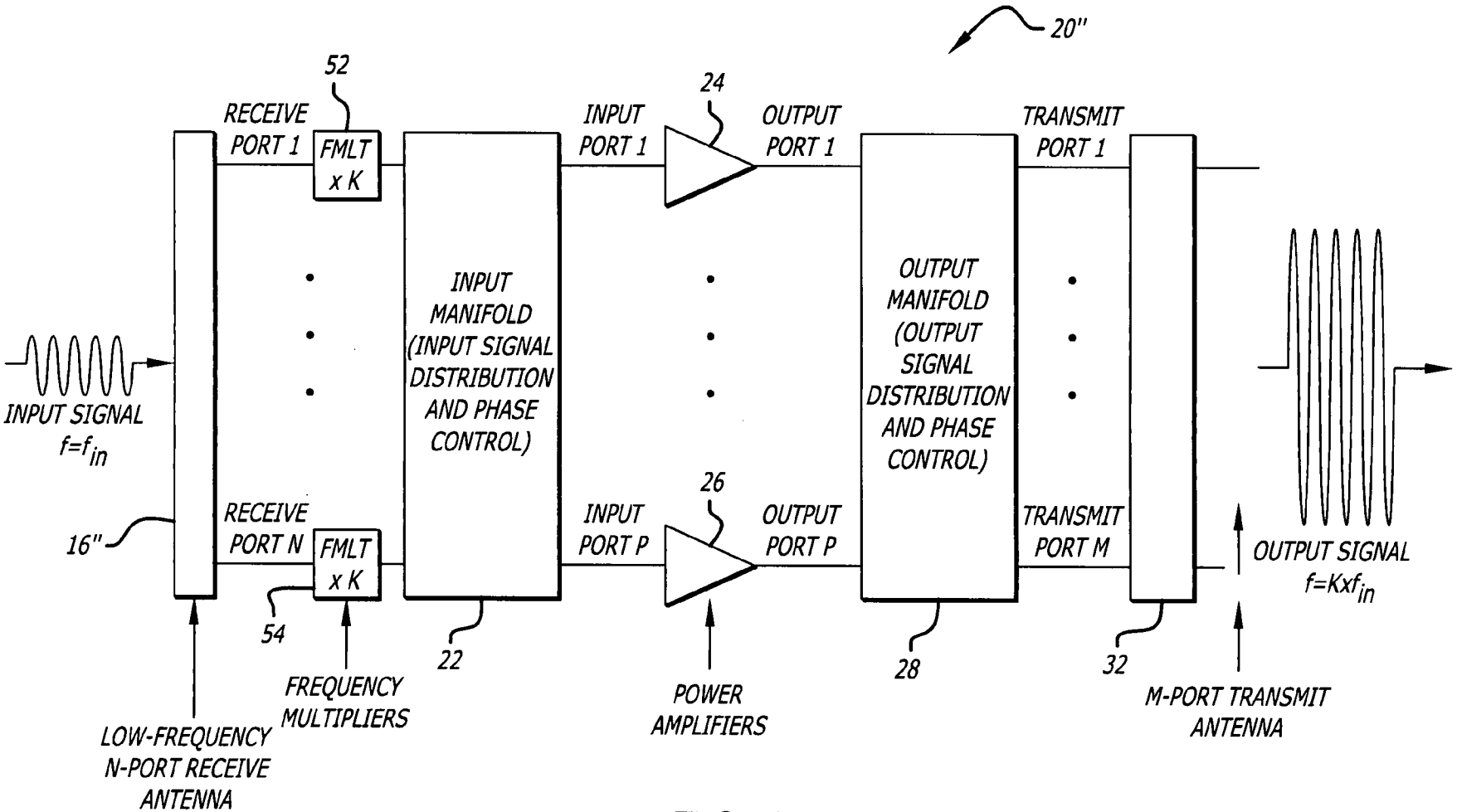
FIG. 11 is a block diagram of an alternative embodiment of a single cell of the antenna of FIG. 1 with multiple parallel receive/transmit paths implemented with a frequency shifting arrangement in accordance with the present teachings.

FIG. 11 is a block diagram of an alternative embodiment of a single cell of the antenna of FIG. 1 with multiple parallel receive/transmit paths implemented with a frequency shifting arrangement in accordance with the present teachings. In this case, one or more cells 20" is implemented as is the cell 20 of FIG. 3 with the exception that N frequency multipliers (52, 54) are included along with a low-frequency receive antenna 16". Those skilled in the art will appreciate that other frequency-converting technologies (e.g., mixers or upconverters) can be utilized in place of frequency multipliers without departing from the scope of the present teachings.

The received polarization need not be the same as the transmitted polarization, e.g., one can construct an active transmit array having a linearly-polarized N-port receive antenna and a circularly-polarized M-port transmit antenna or vice versa. In addition, the system can be designed to convert horizontally polarized energy to vertically polarized energy. The active transmit array can be configured to convert linear polarization to right- or left-handed circular polarization, or to convert a circularly-polarized received signal having one handedness to a transmitted signal having the opposite handedness (right-handed to left-handed, for example). An arrangement for effecting a polarization change is depicted in FIG. 12.

Figure 12:
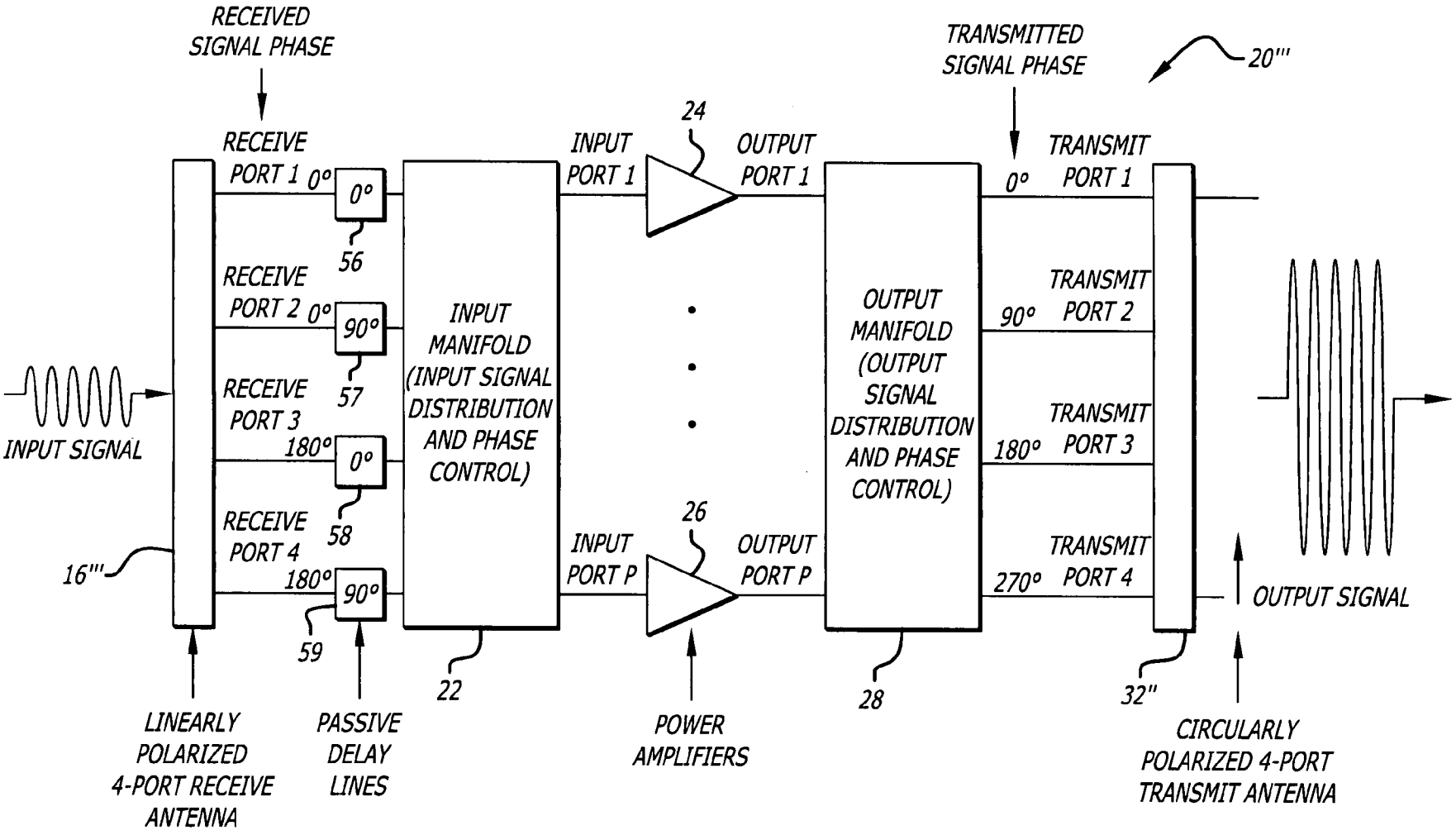
FIG. 12 is a block diagram of an alternative embodiment of a single cell of the antenna of FIG. 1 with multiple parallel receive/transmit paths implemented with a polarization converting arrangement in accordance with the present teachings.

FIG. 12 is a block diagram of an illustrative embodiment of a single cell of the antenna of FIG. 1 with multiple parallel receive/transmit paths implemented with an arrangement for converting linear polarization at the receive antenna to circular polarization at the transmit antenna in accordance with the present teachings. In this case, one or more cells 20''' is implemented as is the cell 20 of FIG. 3 with the exception that passive delay lines 56-59 are included to correct the phases of the signals received by a linearly polarized four-port receive antenna 16'''. On the transmit side, the output manifold feeds a circularly-polarized four-port transmit antenna 32". Note that if P=4, the input and output manifolds may be replaced by lengths of transmission line that connect the amplifier inputs to the receive ports and the amplifier outputs to the transmit ports, respectively.

Further, the invention is not limited to N-port antennas having N-fold rotational symmetry. While this configuration is convenient if a circularly-polarized input and output are desired, many other configurations are possible. For example, one can readily visualize an N-port antenna having 2-fold rotational symmetry and designed to transmit and receive linear polarization.

Neither the receive nor the transmit antenna arrays are required to be flat. Each can be made conformal to a curved surface. In fact, the receive and transmit antenna arrays can be made conformal to different curved surfaces. In addition, the transmit and receive antenna arrays can point in different directions and can be spatially separated. This could prove useful in a communications link, where the receive antenna receives a signal from a transmitter in one direction and the transmit antenna beams an amplified signal towards a transmitter in a different direction. These embodiments are illustrated in FIG. 13.

Figure 13:
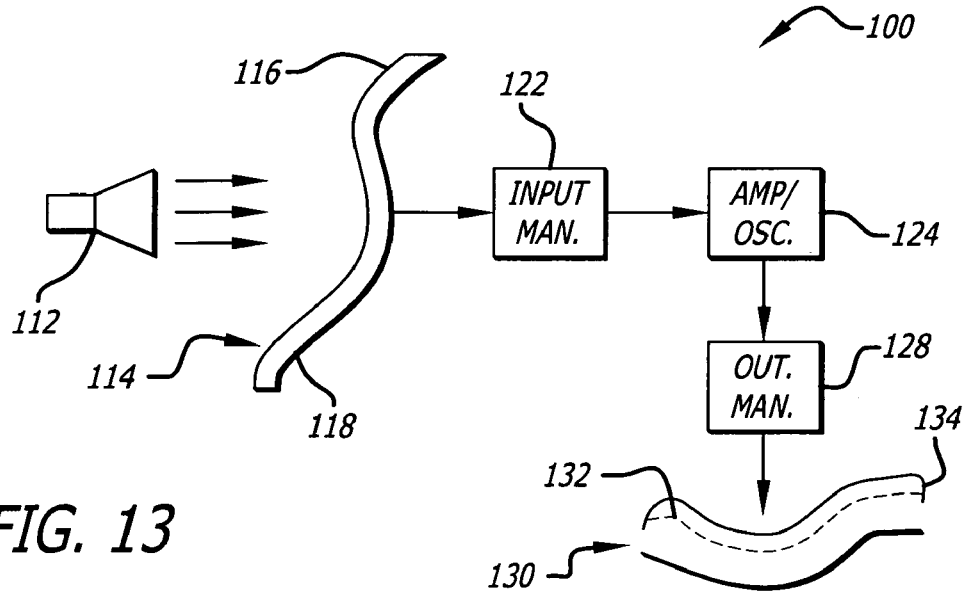
FIG. 13 is a block diagram of an alternative embodiment of the transmit antenna of the present invention illustrative of the use of spatially separated transmit and receive antennas and the mounting of the transmit and receive arrays to conform to curved surfaces.

FIG. 13 is a block diagram of an alternative embodiment of the transmit antenna of the present invention illustrative of the use of spatially separated transmit and receive antennas and the mounting of the transmit and receive arrays to conform to curved surfaces. In this system 100, energy from a source 112 illuminates an array 114 of antenna elements 116 mounted on a curved surface 118. The array 114 outputs signals to a plurality of cells in accordance with the present teachings. Each cell includes an input manifold 122, a plurality of paths with amplifiers, oscillators or other components suitable for a given application, an output manifold 128 and an array 130 of transmit antennas 132 mounted on a second curved surface 134. Those skilled in the art will appreciate that it is not necessary for both surfaces to be curved. Note that the receive and transmit arrays 114 and 130 are spatially separated and point in different directions.

As mentioned above, the receive and transmit antenna arrays can be of different shapes and configurations. In addition, note that the radiated beam can be steered without need for phase shifters and without moving the transmit array. All that is necessary is to move the feed so that it properly illuminates the receive side of the transmit array and points in the desired direction. The non-normal incidence of the incident electromagnetic wave on the receive array will induce currents at the receive ports that cause the transmit array to radiate in the same direction that the feed is pointing.

In summary, the invention is an active transmit array with multiple parallel receive/transmit paths per element. In the illustrative embodiment, for each element, both the receive and transmit antennas have multiple input ports. In the illustrative embodiment, the antennas are multiple-port patch antennas. Other types of multiple-port antennas can also be used. The multiple-port receive antenna feeds an input signal manifold. Together these components distribute the received energy to the inputs of multiple power amplifiers. The power amplifiers, in turn, feed multiple inputs of an output manifold. The output manifold feeds the inputs of a multiple-port transmit antenna.

This approach minimizes or eliminates the need for power dividers and power combiners. In the simplest realization, the input and output manifolds each consist of N transmission lines directly connecting N antenna ports to N power amplifier ports. This realization requires neither power dividers nor power combiners.

In the best mode, the dimensions of an array element are constrained to something less than a wavelength by the need to avoid grating lobe generation. As the element dimensions shrink with increasing frequency, circuit layout becomes more and more critical.

In high-power applications, the goal is often to generate as much power per element as possible. Power combining and power dividing circuitry is passive and occupies circuit area that could otherwise be occupied by power generating circuitry. The active transmit array with multiple parallel/transmit paths per element of the present invention minimizes or eliminates the need for such passive circuitry. Moreover, it utilizes multiple simple low-power amplifiers in place of one or a few complex high-power amplifiers.

The simplicity of the amplifiers simplifies their design as well as their cost and complexity. When built in quantity, one should realize cost savings due to economies of scale.

Hence, the present invention offers the following non-exhaustive list of novel features:

1. Multiple parallel receive-transmit paths per element allow the use of multiple power amplifiers per element without the need for power combiners.

2. Graceful degradation; performance falls off gradually if one or more elements fail per array element.

3. An array of this type can be made conformal to the surface of a desired platform. For example, a transmit array can be embedded in the surface of an aircraft with the feed located on the inside, eliminating the need for a feed boom on the outside as would be required were a reflect array to be used.

A number of possible applications exist for the invention described here. Several illustrative applications are briefly described below.

1. Wireless power transmission. A transmit array such as that described herein can be used as a link in a wireless power transmission network, receiving power transmitted from previous link in the chain, amplifying it to compensate for losses, and retransmitting a collimated beam to the next link in the chain.
2. Communication. In a communication application a two-way link is usually required. The transmit array can be made bi-directional by equipping each transmit array element with two sets of amplifiers and by equipping the antenna ports on both sides of the array with circulators to separate signals traveling in opposite directions.
3. Industrial processing. When used as an amplifying lens, a transmit array may be used to illuminate a sample or test article with a highly focused spot of microwave or millimeter-wave radiation. When the array is equipped with phase shifters, the spot can be moved to a desired location. Possible applications exist in RF heating (semiconductor industry, for example) and in CVD diamond production.

Thus, the present invention has been described herein with reference to a particular embodiment for a particular application. Those having ordinary skill in the art and access to the present teachings will recognize additional modifications applications and embodiments within the scope thereof.

It is therefore intended by the appended claims to cover any and all such applications, modifications and embodiments within the scope of the present invention.

Accordingly,

What is claimed is:

1. An antenna comprising:

an array of N-port receive antennas;

an array of M-port transmit antennas; and a plurality of cells for coupling said receive antennas to said transmit antennas, each cell having plural amplifiers coupled between the receive antenna and the transmit antenna thereof via first and second manifolds, each manifold having a power divider and/or a power combiner.

2. The invention of claim 1 further including means for maintaining said cells in a predetermined relative orientation.

3. The invention of claim 1 wherein said first manifold includes means for distributing signals between said ports of said receive antenna and said amplifiers.

4. The invention of claim 3 wherein said first manifold is a network utilizing power combiners and/or dividers.

5. The invention of claim 4 wherein said network utilizes Wilkinson power combiners and dividers.

6. The invention of claim 5 wherein said second manifold includes means for distributing signals between said amplifiers and said ports of said transmit antenna.

7. The invention of claim 6 wherein said second manifold is a network utilizing power combiners and/or dividers.

8. The invention of claim 7 wherein said network utilizes Wilkinson power combiners and dividers.

9. The invention of claim 1 wherein said receive antenna is a patch antenna.

10. The invention of claim 1 wherein said receive antenna is a multiple port antenna.

11. The invention of claim 10 wherein said receive antenna is an eight-port antenna.

12. The invention of claim 1 wherein said transmit antenna is a patch antenna.

13. The invention of claim 1 wherein said transmit antenna is multiple-port antenna.

14. The invention of claim 13 wherein said transmit antenna is an eight-port antenna.

15. The invention of claim 1 including means for receiving a signal at a first frequency and transmitting a signal at a second frequency.

16. The invention of claim 1 including means for receiving a signal with a first polarization and transmitting a signal with a second polarization.

17. The invention of claim 1 wherein said transmit antenna and said receive antenna of at least one of said cells point in different directions.

18. The invention of claim 1 wherein said transmit antenna and said receive antenna of at least one of said cells are spatially separated.

19. The invention of claim 1 wherein the shape of said transmit antenna differs from the shape of said receive antenna of at least one of said cells.

20. The invention of claim 1 wherein said receive antenna array is conformal to a curved surface.

21. The invention of claim 1 wherein said transmit antenna array is conformal to a curved surface.

22. The invention of claim 1 wherein said receive antenna array is conformal to a first curved surface and said transmit antenna array is conformal to a second curved surface.

23. The invention of claim 1 further including means for steering a beam output by said antenna.

24. The invention of claim 23 wherein said means for steering includes means for receiving energy at a first non-normal angle of incidence.

25. The invention of claim 24 wherein said means for steering includes means for transmitting energy at said non-normal angle of incidence.

26. The invention of claim 24 wherein said means for steering includes means for transmitting energy at a second non-normal angle of incidence.

27. The invention of claim 23 wherein said means for steering includes phase shifters.

28. An antenna comprising:

an array of N-port receive antennas;

an array of M-port transmit antennas; and a plurality of cells for coupling said receive antennas to said transmit antennas, each cell having plural injection-locked oscillators coupled between the receive antenna and the transmit antenna thereof via first and second manifolds, each manifold having a power divider and/or a power combiner.

29. The invention of claim 28 further including means for maintaining said cells in a predetermined relative orientation.

30. The invention of claim 28 wherein each manifold is a network utilizing Wilkinson power combiners and dividers.

31. The invention of claim 28 wherein said receive antenna is a patch antenna.

32. The invention of claim 28 wherein said receive antenna is a multiple-port antenna.

33. The invention of claim 32 wherein said receive antenna is an eight-port antenna.

34. The invention of claim 28 wherein said transmit antenna is a patch antenna.

35. The invention of claim 28 wherein said transmit antenna is a multiple-port antenna.

36. The invention of claim 35 wherein said transmit antenna is an eight-port antenna.

37. The invention of claim 28 including means for receiving a signal at a first frequency and transmitting a signal at a second frequency.

38. The invention of claim 28 including means for receiving a signal with a first polarization and transmitting a signal with a second polarization.

39. The invention of claim 28 wherein said transmit antenna and said receive antenna of at least one of said cells point in different directions.

40. The invention of claim 28 wherein said transmit antenna and said receive antenna of at least one of said cells are spatially separated.

41. The invention of claim 28 wherein the shape of said transmit antenna differs from the shape of said receive antenna of at least one of said cells.

42. The invention of claim 28 wherein said receive antenna array is conformal to a curved surface.

43. The invention of claim 28 wherein said transmit antenna array is conformal to a curved surface.

44. The invention of claim 28 wherein said receive antenna array is conformal to a first curved surface and said transmit antenna array is conformal to a second curved surface.

45. The invention of claim 28 further including means for steering a beam output by said antenna.

46. The invention of claim 45 wherein said means for steering includes means for receiving energy at a first non-normal angle of incidence.

47. The invention of claim 46 wherein said means for steering includes means for transmitting energy at said non-normal angle of incidence.

48. The invention of claim 46 wherein said means for steering includes means for transmitting energy at a second non-normal angle of incidence.

49. The invention of claim 45 wherein said means for steering includes phase shifters.

50. A method for transmitting a signal comprising the steps of:

illuminating an array of N-port receive antennas with a signal;

transmitting said signal from an array of M-port transmit antennas; and providing a plurality of cells for coupling said receive antennas to said transmit antennas, each cell having plural amplifiers coupled between the receive antenna and the transmit antenna thereof via a manifold having a power divider and/or a power combiner.

* * * * *